US006923889B2

(12) United States Patent
Huuskonen et al.

(10) Patent No.: US 6,923,889 B2
(45) Date of Patent: Aug. 2, 2005

(54) PRINTING PAPER

(75) Inventors: Jouni Huuskonen, Valkeakoski (FI); Timo Koskinen, Grand Rapids, MN (US); Heikki Pakarinen, Valkeakoski (FI); Timo Toivanen, Saakoski (FI); Mika Kosonen, Valkeakoski (FI)

(73) Assignee: UPM-Kymmene, Valkeakoski (FI)

( * ) Notice: Subject to any disclaimer, the term of this patent is extended or adjusted under 35 U.S.C. 154(b) by 0 days.

(21) Appl. No.: 10/717,869

(22) Filed: Nov. 19, 2003

(65) Prior Publication Data

US 2004/0154765 A1 Aug. 12, 2004

Related U.S. Application Data

(63) Continuation of application No. PCT/FI02/00427, filed on May 20, 2002.

(30) Foreign Application Priority Data

May 23, 2001 (FI) ..... 20011079

(51) Int. Cl.[7] ..... D21H 19/36; D21H 11/08; D21H 11/10; D21H 5/02

(52) U.S. Cl. ..... 162/135; 162/142; 162/150; 162/204; 162/55; 428/334

(58) Field of Search ..... 162/135, 142, 162/150, 55; 427/361, 391; 428/195.1, 334, 341

(56) References Cited

U.S. PATENT DOCUMENTS 4,298,652 A * 11/1981 Suzuki et al. ..... 428/323
4,776,926 A * 10/1988 Lindahl ..... 162/28
4,938,843 A * 7/1990 Lindhal ..... 162/55
5,376,237 A 12/1994 Ishiguro et al. ..... 162/132
5,753,077 A * 5/1998 Horand et al. ..... 162/135
6,022,448 A * 2/2000 Eriksson et al. ..... 162/123
6,287,424 B1 * 9/2001 Mohan et al. ..... 162/206
6,391,154 B1 * 5/2002 Nyg.ang.rd et al. ..... 162/135
6,497,790 B2 * 12/2002 Mohan et al. ..... 162/206
6,527,914 B1 * 3/2003 Shevchenko et al. ..... 162/142
6,531,183 B1 * 3/2003 Cason et al. ..... 427/361
2003/0006016 A1 * 1/2003 Tienvieri et al. ..... 162/20
2003/0015305 A1 * 1/2003 Tienvieri et al. ..... 162/56
2003/0056915 A1 * 3/2003 Hietanen et al. ..... 162/141
2003/0106658 A1 * 6/2003 Ilmonen et al. ..... 162/135
2004/0045686 A1 * 3/2004 Nisogi et al. ..... 162/135

FOREIGN PATENT DOCUMENTS

| | | |
|---|---|---|
| EP | 0 908 557 | 4/1999 |
| GB | 2 047 568 | 12/1980 |
| WO | WO 00/34584 | 6/2000 |
| WO | WO 01/42557 | 6/2001 |

* cited by examiner

*Primary Examiner*—José A. Fortuna
(74) *Attorney, Agent, or Firm*—Fitch, Even, Tabin & Flannery

(57) ABSTRACT

The invention relates to coated printing paper which contains mechanical pulp and whose opacity is at least 89%, brightness at least 65% and surface roughness not more than 4.5 μm. The printing paper contains mechanical pulp at least 90 weight-% of the total fiber content of the paper.

10 Claims, 5 Drawing Sheets

PRINTING PAPER

This is a continuation, of prior application number PCT/FI02/00427 designating the U.S., filed May 20, 2002, which is hereby incorporated herein by reference in its entirety.

The present invention relates to coated printing paper which contains mechanical pulp and whose opacity is at least 89%, brightness at least 65% and surface roughness not more than 4.5 μm.

BACKGROUND OF THE INVENTION

Known coated printing papers which contain mechanical pulp and whose opacity is at least 89%, brightness at least 65% and surface roughness not more than 4.5 μm, include for example machine finished coated (MFC), film coated offset (FCO), light weight coated (LWC) and heavy weight coated (HWC) papers.

MFC papers refer to coated papers whose coating content varies from 5 to 10 g/m$^2$ per paper side and which are used for magazines, catalogues, books, and commercial printed matter. The grammage of MFC papers varies from 48 to 80 g/m$^2$. Of the fibre content of the paper, 60 to 80% is mechanical pulp and 15 to 40% is chemical pulp. The total filler content of the coated paper is 20 to 30 weight-%. In some cases, MFC papers also include MFP papers whose coating content is normally from 2 to 5 g/m$^2$ per paper side.

LWC papers refer to coated papers whose coating content varies from 5 to 12 g/m$^2$ per paper side and which are used for magazines, catalogues, inserts, and commercial printed matter. The grammage of LWC papers varies from 35 to 80 g/m$^2$. Of the fibre content of the paper, 50 to 70% is mechanical pulp and 30 to 50% is chemical pulp. In un-coated base paper, the filler content is 4 to 10% of the total mass of the base paper. The total filler content of coated paper is 24 to 36 weight-%.

HWC papers refer to coated papers with a considerably high coating content. FCO papers refer to coated papers with a film coating.

The above-mentioned paper grades have the problem of high chemical pulp content which the papers must have to achieve the desired properties. The printing paper according to the invention provides an alternative to replace coated papers of prior art, and an improvement in certain properties of the paper.

SUMMARY

The coated printing paper according to the invention is characterized in that it contains mechanical pulp at least 90 weight-% of the total fibre content of the paper. The coated printing paper according to the invention has good opacity which is achieved when chemical pulp is used little or not at all. The printing paper according to the invention is stiffer than other printing papers used for the same purposes. The printing paper has a relatively high bulk. The desired bulk can be influenced by calendering, wherein it is possible to achieve very good printability of the paper. It is inexpensive to manufacture, because the quantity of chemical pulp is low or non-existent.

The coated printing paper according to the invention is intended to replace the above-mentioned paper grades, particularly LWC and MFC papers, which have an opacity of at least 89%, a brightness of at least 65%, preferably at least 70%, and a surface roughness of not more than 4.5 μm, preferably not more than 3.0 μm. Normally, the brightness value required is at least 70% and the surface roughness value is not more than 3.0 μm, but for some insert grades, the allowed brightness and surface roughness values are at least 65% and not more than 4.5 μm, respectively. Inserts refer to for example special newspapers, newspaper supplements and handouts. The numerical values referred to have been obtained by the following testing methods:

opacity SCAN-P 8:93 brightness SCAN-P 3:93 surface roughness SCAN-P 76:95

Paper with a high content of mechanical pulp will have a poorer tear resistance than corresponding papers containing more chemical pulp. The tear resistance will be further decreased by coating of the paper. Surprisingly, this did not affect the runnability of the paper in the machine, although this should, according to a common assumption, correlate better with the runnability of the paper.

In the printing paper according to the invention, the mechanical pulp used is advantageously special thermomechanical pulp (TMP) whose production will be discussed below in this application. By using the special thermomechanical pulp, good values are achieved for the paper in, for example, breaking energy, tensile strength and elongation. In the paper manufacturing process, the aim is to replace such parts which cause impairing of the properties of the paper, with new constructions. For example, in the press section of the paper machine, the paper web is arranged to be supported during the running, wherein the elongation properties of the paper remain good, because it is not necessary to use such a high running tension for the web as would be necessary if the web were unsupported during the running.

Very good properties are achieved for the coated printing paper according to the invention, even though the content of chemical pulp in the paper is very low or non-existent. The coated printing paper may contain chemical pulp not more than 10 wt-% of the total fibre content of the paper; advantageously, it contains chemical pulp not more than 5 weight-% of the total fibre content of the paper; and preferably, the total fibre content of the printing paper is mechanical pulp.

The mechanical pulp to be used in the manufacture of coated printing paper is preferably refiner mechanical pulp, for example thermomechanical pulp (TMP). The thermomechanical pulp is refined and screened to make it very bondable and strong pulp. Typically, it has a relatively high content of long fibres and fines but a lower content of medium-size fibres than normally. However, the fibre distribution may differ from the typical distribution presented above, and strong and bondable pulp can still be achieved by the fibre manufacturing method.

The method for manufacturing fibrous pulp can be used to produce mechanical fibre pulp with a high proportion of long fibres. In this application, mechanical pulp refers to fibre pulp made of wood material, such as wood chips, by beating. In connection with the beating, the wood material and/or the fibre pulp is subjected to thermal treatment, wherein it is a process for producing thermomechanical pulp. In addition to the thermal treatment, the wood raw material may also have been treated with chemicals before the beating, wherein it is a process for producing chemi-thermomechanical pulp.

By the method, it is possible to achieve an average fibre length of about 10% higher than by methods used before, if desired. It is typical of the method that the content of short fibres in the fibre pulp remains approximately the same as before, but the content of medium-size fibres is reduced and the relative content of long fibres is increased. However, it is not necessarily the fibre length and its distribution that is the determining factor but, by controlling the process, the method can be used to produce various fibre distributions which are each characterized in high strength and bondability, Surprisingly, such fibre pulp can be used to make paper which has a good formation and whose properties meet the high demands set for printing paper. Conventionally, long average fibre length and fibre pulp with a good formation have been difficult to achieve in the same product, because it has not been known to refine fibres to fines, simultaneously retaining a relatively long fibre length. Furthermore, in the method for producing fibre pulp according to the invention, the energy consumption is lower than in methods of prior art aiming at the same freeness level. The freeness value of the finished fibre pulp is from 30 to 70 ml CSF. In this application, the freeness value refers to the Canadian Standard Freeness value with the unit of ml CSF. The freeness value can be used to indicate the degree of beating of the pulp. According to prior art, the following correlation is present between the freeness value and the specific surface area of the fibres:

$A=-3{,}03 \ln(CSF)+21{,}3$, in which $A$=total specific surface area of the pulp (unit $m^2/g$).

According to the above-mentioned formula, the total specific surface area of the pulp is increased as the freeness value is decreased; in other words, the freeness value gives a clear indication of the beating degree, because as the content of fines is increased, the specific surface area of the fibres will increase.

The wood species which are presented as suitable raw materials used in this application, are spruce (genus *Picea*, several different species), silver fir (genus *Abies*, several different species), pine (*Pinus sylvestris*), and Southern pine (genus *Pinus*, several different species). It is also possible that the fibre pulp made of wood raw material contains fibre pulp obtained from at least two different wood species and/or fibre pulp made in at least two different ways, which are mixed together at a suitable production step.

The production of fibre pulp comprises the primary beating of a suitable wood material and subsequent beating and screening steps. The so-called primary beating, or the first step of the beating process, is performed at a high temperature of 165 to 175° C. and at a high pressure of 600 to 700 kPa (6 to 7 bar) for a short time, wherein most of the fibre pulp remains relatively rough. The average retention time of the raw material to be supplied in a high-pressure refiner is only 5 to 10 seconds. The temperature during the beating is determined by the pressure of saturated steam.

In the first beating step, preferably one-step beating is only used. However, there can be several refiners in parallel at the same step. After the first beating step, the freeness value of the fibre pulp is 250 to 700 ml CSF. After the first beating step, the fibre pulp is screened to a first accepted fibre pulp grade and a first rejected fibre pulp grade. After the fibre pulp has been screened to the first accepted fibre pulp grade and the first rejected fibre pulp grade, there are different ways to continue the process, for example 1-step processing of the first rejected fibre pulp grade, in which the rejected fibre pulp is refined and screened in one step. Accepted fibre pulp grades are removed from the process after each screening step and/or accepted fibre pulp grades are re-screened, or 2-step processing of the first rejected fibre pulp grade, in which the rejected fibre pulp is refined and screened in two steps. Accepted fibre pulp grades are removed from the process after each screening step and/or accepted fibre pulp grades are re-screened, or 3-step processing of the first rejected fibre pulp grade, in which the rejected fibre pulp is refined and screened in three steps, and accepted fibre pulp grades are removed from the process after each screening step, or forward coupled processing of rejected fibre pulp in two or three steps, which refers to the processing of rejected fibre pulp in first two or three steps and and the removal of accepted fibre pulp grades from the process after each screening step, followed by the beating of the last remaining rejected fibre pulp grade in, for example, a low-consistency refiner and the removal of all the fibre pulp processed in the low-consistency refiner from the process.

In the above-mentioned alterative, each step comprises a refiner and a screen, one after the other. Said embodiments will be presented in detail hereinbelow. The accepted fibre pulp grades obtained from different steps in the process are combined and mixed with each other, bleached preferably by peroxide bleaching, and used as raw material for papermaking in a paper machine. The apparatus for producing fibre pulp may comprise several production lines in parallel, the resulting accepted fibre pulp grades being combined with each other.

The fibre pulp obtained from the process for producing fibre pulp is led for use in a paper machine. The principle of the papermaking process is known as such. However, the papermaking line is provided with such modifications that wet paper with a poor strength can be made without affecting the runnability; in other words, the aim of the new arrangements is to avoid web breaks. The running speed used in the paper machine during papermaking is higher than 1300 m/min, advantageously higher than 1500 m/min and preferably higher than 2000 m/min.

In the press section of the paper machine, the web has a closed transfer, which means that the web is supported when running in the press section. This has an advantageous effect on, for example, the elongation properties of the web. Thus, the tension of the web does not need to be as high as if the web were unsupported during the running. The press section of the paper machine can be, for example, OptiPress® (Metso Paper, Inc., Finland).

The paper is coated with a suitable coating method, such as film coating. The coating preferably contains kaolin and/or calcium carbonate. The coating content used is preferably 3 to 9 $g/m^2$ per paper side.

The paper is calendered at a suitable nip pressure in a multi-nip calender, which can be, for example, OptiLoad® (Metso Paper, Inc., Finland).

DESCRIPTION OF THE DRAWINGS

The production of the fibre pulp will be described in more detail with reference to FIGS. 1 to 5 which show principle process charts for the production of fibre pulp.

DETAILED DESCRIPTION

Figure 1:
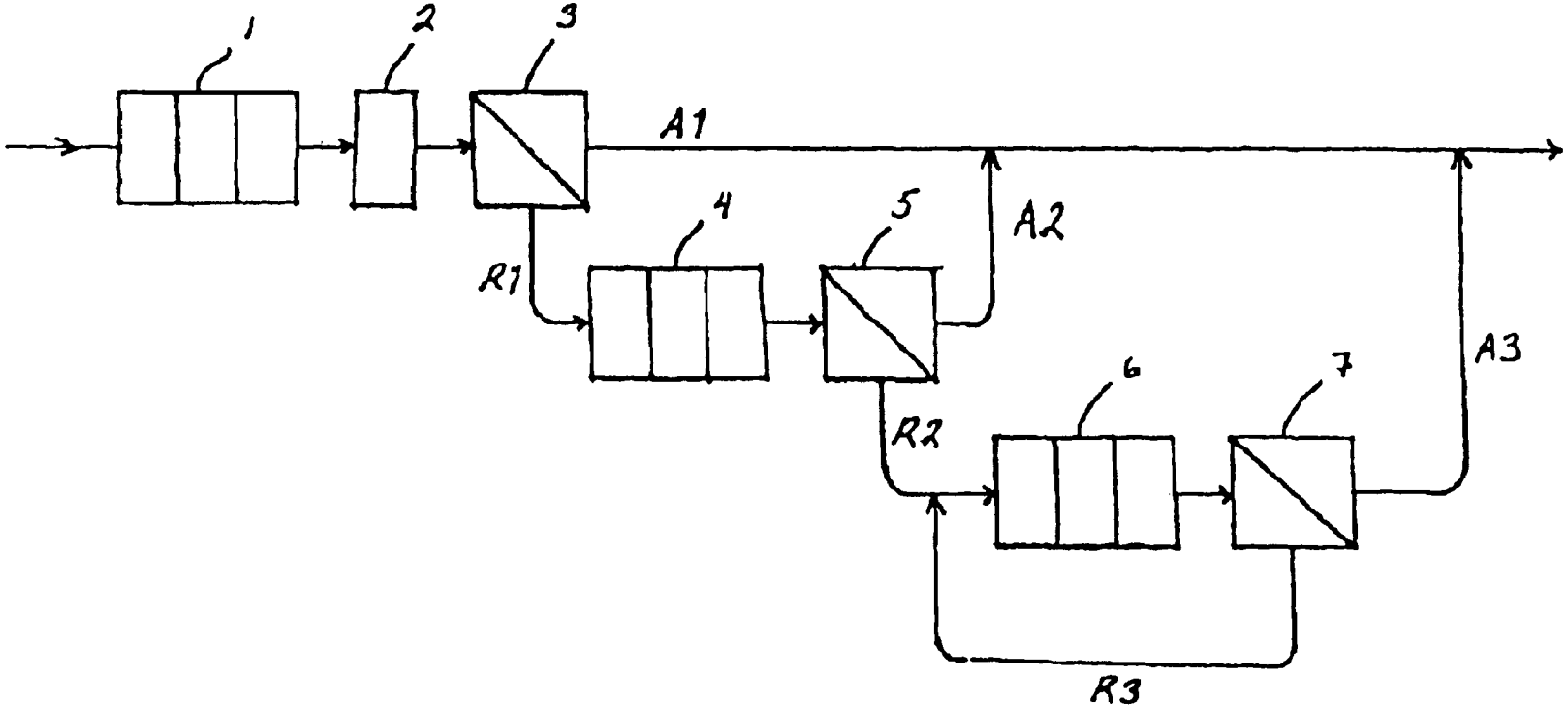

Before the feeding of wood chips into the process of FIG. 1, the wood chips are pretreated in hot steam under pressure, wherein the wood chips are softened. The pressure in the pretreatment is preferably 50 to 800 kPa. For the pretreatment of the wood chips, it is also possible to use chemicals, for example, alkali peroxide or sulphite treatments, such as sodium sulphite treatments. Before the refiners, there are normally also devices intended for steam separation, such as cyclones.

In the process of FIG. 1, the wood chips are fed at a consistency of 40 to 60%, for example about 50%, to a refiner 1, which yields fibre pulp with a freeness value of 250 to 700 ml CSF. When spruce (*Picea abies*) is used as the raw material, the average fibre length after the refiner 1 is at least 2.0 mm. The pressure used at the refiner 1 is high, an overpressure of more than 400 kPa (an overpressure of more than 4 bar), preferably 600 to 700 kPa. Overpressure refers to overpressure compared to normal atmospheric pressure. The refiner 1 can be a conical or disc refiner, preferably it is a conical refiner. A longer fibre can be obtained with a conical refiner than with a disc refiner. The energy consumption at the refiner 1 is 0.4 to 1.2 MWh/t.

The fibre pulp is fed via a latency container 2 to a screen 3. In the latency container 2, fibres curled during the beating are straightened out, when they are held in hot water for about one hour. The consistency in the latency container 2 is 1 to 5%.

The screen 3 yields a first accepted fibre pulp grade A1 with a freeness value of 20 to 50 ml CSF. Of the total fibre pulp, 60 to 90%, preferably about 80% is passed to a first rejected fibre pulp grade R1. After dewatering, the first rejected fibre pulp grade R1 is fed at a consistency of 30 to 60%, preferably about 50%, to a refiner 4 and further at a consistency of 1 to 5% to a screen 5. The energy consumption at the refiner 4 is 0.5 to 1.8 MWh/t.

The refiner 5 yields a second accepted fibre pulp grade A2 and a second rejected fibre pulp grade R2, which contains 60 to 80% of the rejected fibre pulp grade R1 of the preceding step screened in screen 5. The second rejected fibre pulp grade R2 is led at a consistency of 30 to 60%, preferably 50%, to a refiner 6 and further at a consistency of 1 to 5% to a screen 7, which yields a third accepted fibre pulp grade A3 and a third rejected fibre pulp grade R3, which is returned to the feeding of the refiner 6. The energy consumption at the refiner is 0.5 to 1.8 MWh/t. The total fibre pulp, which is obtained by combining the accepted fibre pulp grades A1, A2 and A3, has a freeness value of 30 to 70 ml CSF.

The above-presented energy consumption values relating to the process of FIG. 1 correspond to the energy consumption when the wood chips are not treated with chemicals, that is, the pulp is thermome-chanical pulp.

The pressure at the refiners 4 and 6 may be high, at least more than 400 kPa (more than 4 bar), preferably 600 to 700 kPa (6 to 7 bar), or it can be on the normal level, at a maximum of 400 kPa, preferably 300 to 400 kPa.

Dewatering before the refiners, to achieve a consistency of 30 to 60%, preferably about 50%, is performed by screw presses or corresponding devices which can be used to remove so much water from the process that said high consistency is achieved. The dilution of the fibre pulp before the screening, in turn, is performed by pumping water into the process, by pumps suitable for the purpose.

The fibre pulp is screened by known methods. In the screens, it is possible to use, for example, a slotted screen with a slot size of 0.10 to 0.20 mm and a profile height suitably selected in view of the screening situation and the desired final result. In a process including several screening steps, the slot size of the screens is normally increased towards the end of the process. The properties of the screens must be selected, for example, in such a way that they are not blocked in abnormal running situations, for example when the process is started. The consistency is normally 1 to 5% when slotted screens are used.

One possibility to screen the fibre pulp is a vortex cleaner; when it is used, the consistency must be adjusted lower than in the use of a slotted screen. The consistency is preferably about 0.5% when a vortex cleaner is used.

Measured by the Bauer-McNett method, the fibre distribution of the finished fibre pulp, obtained by combining and mixing the acceptable fibre pulp grades A1, A2 and A3, is typically the following:

40–50% of the fibres will not pass screens with a slot size of 16 mesh and 28 mesh, 15–20% of the fibres will pass screens of 16 and 28 mesh but will not pass screens with a slot size of 48 mesh and 200 mesh, and 35–40% of the fibres will pass screens of 48 and 200 mesh; that is, these fibres pass through all the screens used (up to 200 mesh).

The average fibre length of the fibres left on the 16 mesh screen is 2.75 mm, the average fibre length of the fibres left on the 28 mesh screen is 2.0 mm, the average fibre length of the fibres left of the 48 mesh screen is 1.23 mm, and the average fibre length of the fibres left on the 200 mesh screen is 0.35 mm. (Source: J. Tasman: The Fiber Length of Bauer-McNett Screen Fractions, TAPPI, Vol. 55, No. 1 (January 1972))

Thus, the resulting fibre pulp contains 40 to 50% of fibres with an average fibre length of more than 2.0 mm, 15 to 20% of fibres with an average fibre length of more than 0.35 mm, and 35 to 40% of fibres with an average fibre length of less than 0.35 mm. However, the fibre distribution may differ from that presented above.

Figure 2:
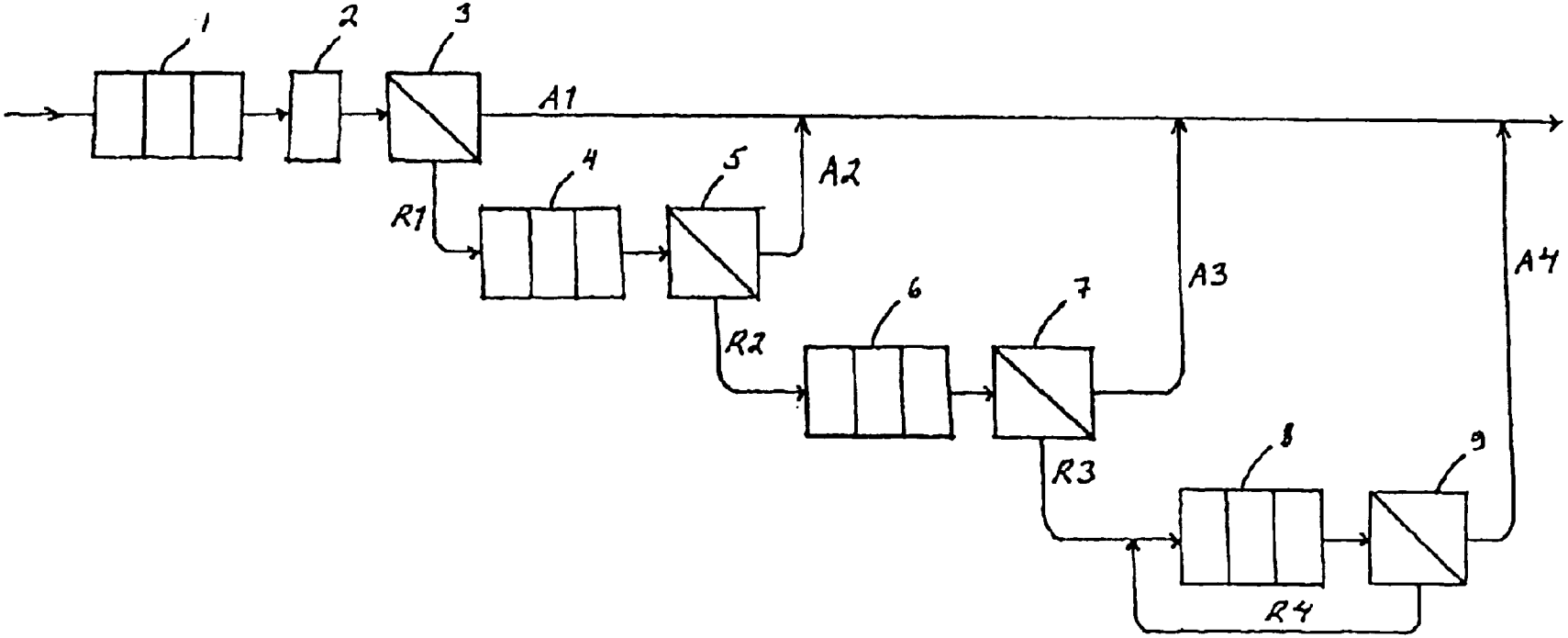

FIG. 2 shows a second embodiment of the invention. The beginning of the process is similar to that shown in FIG. 1, but the third rejected fibre pulp grade R3 is led to a refiner 8 and further to a screen 9. The fourth accepted fibre pulp grade A4 obtained from the screen 9 is led to be combined with the other accepted fibre pulp grades A1, A2 and A3. The fourth rejected fibre pulp grade R4 is led back to the input of the refiner 8. This kind of an arrangement may be necessary when the aim is to achieve a low freeness level, for example the level of 30 ml CSF.

Figure 3:
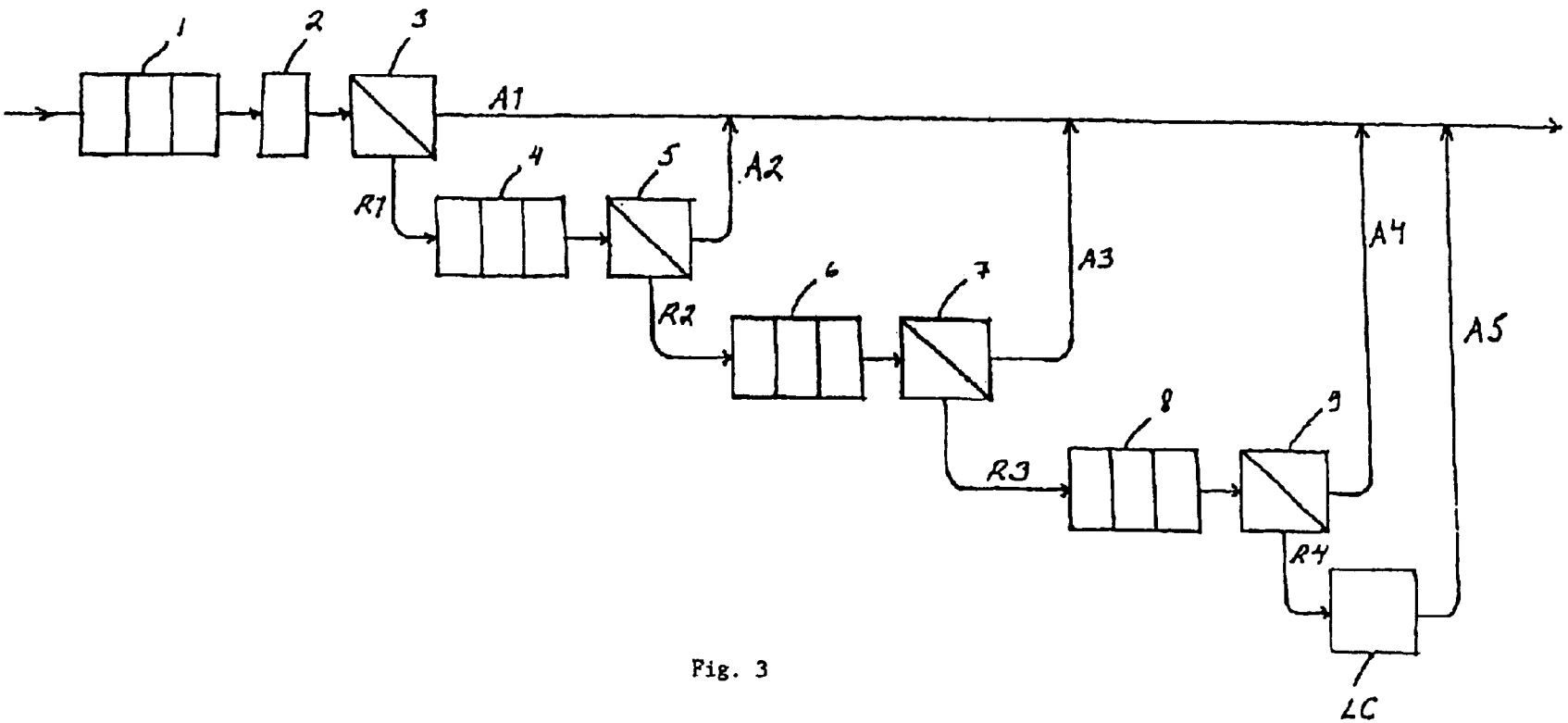

FIG. 3 shows a third embodiment of the invention. The beginning of the process is similar to that shown in FIG. 2, but the fourth rejected fibre pulp grade R4 is led to a low-consistency refiner LC. The consistency of the fibre pulp grade R4 to be fed into the low-consistency refiner LC is 3 to 5%. The resulting accepted fibre pulp grades A1, A2, A3, A4, and A5 are combined and mixed to finished fibre pulp.

Figure 4:
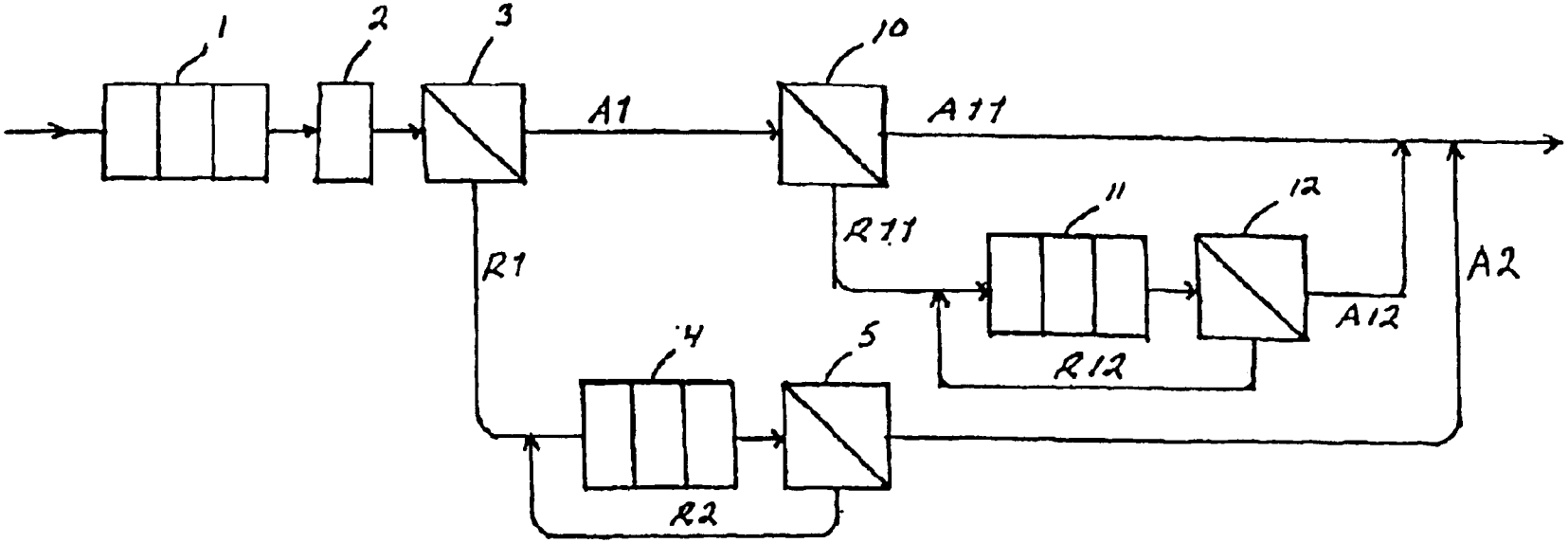

FIG. 4 shows a fourth embodiment of the invention. The rejected fibre pulp grade R1 obtained from the screen 3 is led to a refiner 4 and further to a screen 5. The rejected fibre pulp grade obtained from the screen 5 is led back to the inlet of the refiner 4. The accepted fibre pulp grade A2 obtained from the screen 5 is removed from the process.

The accepted fibre pulp grade A1 obtained from the screen 3 is led to be re-screened in a screen 10. The accepted fibre pulp grade A11 obtained from the screen 10 is removed from the process. The rejected fibre pulp grade R11 obtained from the screen 10 is led to a refiner 11 and further to a screen 12. The rejected fibre pulp grade R12 obtained from the screen 12 is led back to the inlet of the refiner 11. The accepted fibre pulp grade A12 obtained from the screen 12 is removed from the process, to be combined with the other accepted fibre pulp grades A11 and A2.

Figure 5:
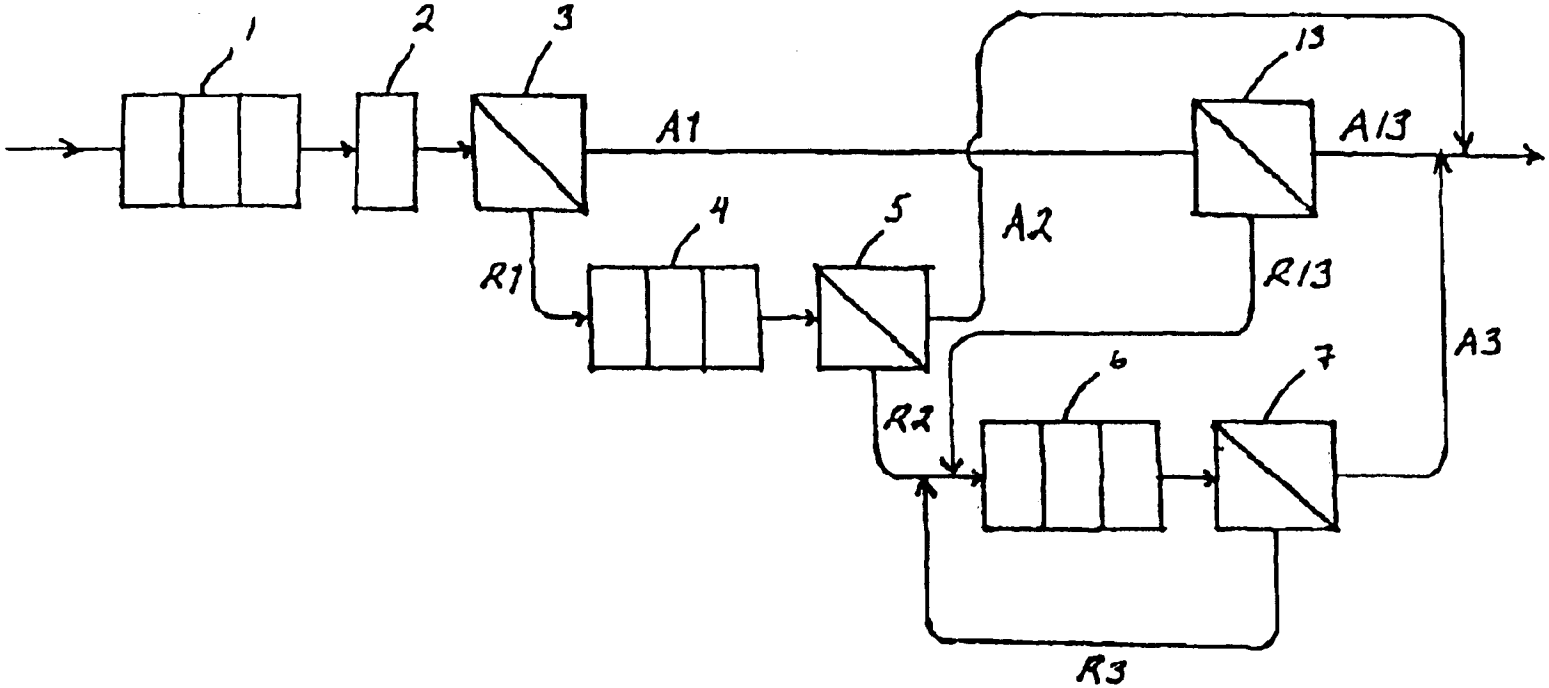

FIG. 5 shows a fifth embodiment of the Invention. The process is, in other respects, similar to that shown in FIG. 1, but the accepted fibre pulp grade A1 obtained from the screen 3 is led to be re-screened in a screen 13. The accepted fibre pulp grade A13 obtained from the screen 13, the accepted fibre pulp grade A2 obtained from the screen 5, and the accepted fibre pulp grade A3 obtained from the screen 7 are combined and mixed and led to be used in the paper making process. The rejected fibre pulp grade R13 obtained from the screen 13 is combined with the rejected fibre pulp grades R2 and R3, and the combined fibre pulp is led to the refiner 6.

The wood raw material used in the process may be any kind of wood, but normally it is softwood, preferably spruce, but also for example pine or Southern pine are suitable wood raw materials for the use. When spruce is used as the wood raw material and the wood chips are not treated with chemicals, the energy consumption is about 2.8 MWh/t, of which about 0.3 MWh/t is consumed to adjust the consistency to be suitable for each process step. In the process according to FIG. 1, the energy consumption is 0.4 to 1.2 MWh/t in the first step of the beating, 0.5 to 1.8 MWh/t in the second step of the beating, and 0.5 to 1.8 MWh/t in the third step of the beating. The required processing energy is greater for pines than for spruce; for example, the processing of Southern pine requires about 1 MWh/t more energy than spruce. Also the change in the wood chip size will affect the energy consumption. The above-mentioned energy consumption values result from tests in which the wood chips had an average size of 21.4 mm and an average thickness of 4.6 mm according to a test screening.

It is also possible to implement the above-described processes for the production of fibre pulp by using a screen which performs the screening at substantially the same consistency as that of the beating. In this case, the energy consumption will be lower, because the amount of energy taken for the adjustment of the consistency will be saved.

In the following, the invention will be described in more detail by means of examples. The test results presented In the examples have been obtained by using test methods listed below.

| | |
|---|---|
| Grammage | SCAN-C28:76/SCAN-M8:76 |
| Thickness | SCAN-P 7:96 |
| Bulk | SCAN-P 7:96 |
| Filler content | SCAN-P 5:63 |
| Tensile strength | SCAN-P 38:80 |
| Elongation | SCAN-P 38:80 |
| Tear resistance | SCAN-P 11:96 |
| Bending strength | SCAN-P 29:95 |
| Bending length | mod. ASTM:D 1388-96 |
| Bonding strength | TAPPI Useful Method 403 (instructions for RD device) |
| ISO brightness | SCAN-P 3:93 |
| D65 brightness | SCAN-P 66:93 |
| Opacity | SCAN-P 8:93 |
| Air permeance | SCAN-P 19:78 |
| PPS roughness | SCAN-P 76:95 |
| Gloss (%) | 75° T 480 |

EXAMPLE 1

During the manufacture of coated printing paper according to the invention, calender tests were made with an OptiLoad® calender. The nip pressure was 500 kN/m. A 6-roll calender was used for sample 1, an 8-roll calender for samples 2 to 4. The temperature of the calender was adjusted so that it was 110° C. during the calendering of the sample 2, 125° C. during the calendering of sample 3, and 140° C. during the calendering of sample 3. The properties measured of the samples are given in Table 1.

TABLE 1

Properties of some coated printing papers according to the invention.

| | Sample | | | |
|---|---|---|---|---|
| | 1 | 2 | 3 | 4 |
| Grammage (g/m$^2$) | 52.8 | 52.2 | 52.9 | 52.3 |
| Thickness (μm) | 58 | 57 | 58 | 52 |
| Density (kg/m$^3$) | 951 | 966 | 972 | 999 |
| Bulk (cm$^3$/g) | 1.06 | 1.03 | 1.02 | 1 |
| Filler content 560° C. (%) | 20.8 | 20.8 | 20.4 | 20.8 |
| Mechanical pulp (%) | 100 | 100 | 100 | 100 |
| Chemical pulp (%) | 0 | 0 | 0 | 0 |
| Tensile strength in machine direction (kN/m) | 3.13 | 3.09 | 3.18 | 3.22 |
| Elongation (%) | | | | |
| machine direction | 1 | 1 | 1 | 1 |
| cross-machine direction | 1.6 | 1.4 | 1.7 | 1.4 |
| Tear resistance (mN) | | | | |
| cross-machine direction | 155 | 151 | 149 | 155 |
| Bending strength (mN) | | | | |
| machine direction | 31 | 29 | 29 | 27 |
| cross-machine direction | 16 | 14 | 15 | 14 |
| Bending length (mm) | | | | |
| machine direction | 115 | 116 | 117 | 115 |
| cross-machine direction | 89 | 86 | 92 | 85 |
| Bonding strength SB Low (J/m$^2$)* | 308 | 293 | 260 | 304 |
| Brightness ISO ts | 71 | 71.2 | 70.8 | 70.3 |
| Brightness D65 ts | 71.1 | 71.1 | 70.9 | 70.2 |
| Opacity (%) | 93 | 93.1 | 93.3 | 92.5 |
| Air permeance (s/100 ml) | 970 | 760 | 800 | 1020 |
| Roughness PPS (μm) | 1.76 | 1.79 | 1.63 | 1.55 |
| Gloss (%) | | | | |
| machine direction | 48 | 45 | 49 | 54 |

*In the measurement of the bonding strength, the scale SB Low (0 to 525 J/m$^2$) has been used.

EXAMPLE 2

A comparison was made between the properties of the coated printing paper according to the invention and coated printing papers of prior art. The grammages of the samples to be compared in the same table are substantially the same. The properties are presented in tables 2 to 4.

TABLE 2

Properties of coated printing papers The coated printing paper according to the invention is sample 5, samples of prior art are samples 6 to 8.

| | Sample | | | |
|---|---|---|---|---|
| | 5 | 6 | 7 | 8 |
| Grammage (g/m$^2$) | 52 | 51.6 | 51.6 | 50.6 |
| Thickness (μm) | 57 | 47 | 47 | 48 |
| Density (kg/m$^3$) | 954 | 1092 | 1100 | 1061 |
| Bulk (cm$^3$/g) | 1.048 | 0.92 | 0.91 | 0.94 |
| Filler content 560° C. (%) | 28.2 | 25.5 | 30.5 | 29.7 |
| Mechanical pulp (%) | 100 | 56 | 65 | 70 |
| Chemical pulp (%) | 0 | 44 | 35 | 30 |
| Tensile strength in machine direction (kN/m) | 2.96 | 4.01 | 2.78 | 2.82 |
| Elongation (%) | | | | |
| machine direction | 0.9 | 1.25 | 1.2 | 1.1 |

TABLE 2-continued

Properties of coated printing papers The coated printing paper according to the invention is sample 5, samples of prior art are samples 6 to 8.

| | Sample | | | |
|---|---|---|---|---|
| | 5 | 6 | 7 | 8 |
| Tear resistance (mN) | | | | |
| cross-machine direction | 132 | 373 | — | 242 |
| Bending strength (mN) | | | | |
| machine direction | 28 | 18.9 | 20 | 17 |
| cross-machine direction | 13 | 9.6 | 11 | 9.5 |
| Bending length (mm) | | | | |
| machine direction | 106 | 96 | — | 97 |
| cross-machine direction | 84 | 71 | — | 76 |
| Bonding strength SB High ($J/m^2$)** | 202 | 286 | 294 | 318 |
| Brightness ISO ts | 72.1 | 69.4 | 72.1 | 69.7 |
| Brightness D65 ts | 72.4 | 69.5 | 73 | 71.7 |
| Opacity (%) | 92.4 | 90.1 | 92.6 | 92.4 |
| Air permeance (s/100 ml) | 1700 | 2207 | 1030 | 1918 |
| Roughness PPS (μm) | 1.97 | 1.51 | 1.26 | 1.66 |
| Gloss (%) | | | | |
| machine direction | 44 | 51 | 57 | 52.8 |

**In the measurement of the bonding strength, the scale SB High (210 to 1051 $J/m^2$) has been used.

TABLE 3

Properties of coated printing papers The coated printing paper according to the invention is sample 9, samples of prior art are samples 10 to 13.

| | Sample | | | | |
|---|---|---|---|---|---|
| | 9 | 10 | 11 | 12 | 13 |
| Grammage ($g/m^2$) | 60.5 | 60.5 | 59.4 | 59.2 | 59.6 |
| Thickness (μm) | | 55 | 52 | 56 | 65 |
| Density ($kg/m^3$) | 966 | 1108 | 1152 | 1050 | 907 |
| Bulk ($cm^3/g$) | 1.035 | 0.9 | 0.87 | 0.95 | 1.11 |
| Filler content 560° C. (%) | 25.8 | 30.3 | 32.9 | 32 | 25.8 |
| Mechanical pulp (%) | 100 | 66 | 52 | 73 | 84 |
| Chemical pulp (%) | 0 | 34 | 48 | 27 | 16 |
| Tensile strength in machine direction (kN/m) | 3.8 | 4.01 | 3.42 | 3.41 | 3.02 |
| Elongation (%) | | | | | |
| machine direction | 1 | 1.35 | 1.17 | 1.2 | 1.27 |
| Tear resistance (mN) | | | | | |
| cross-machine direction | 190 | 365 | 301 | — | — |
| Bending strength (mN) | | | | | |
| machine direction | 44 | 26 | 20 | 26 | 38 |
| cross-machine direction | 21 | 12 | 9 | 12 | 22 |
| Bending length (mm) | | | | | |
| machine direction | 128 | 106 | 99 | 101 | 118 |
| cross-machine direction | 100 | 80 | 62 | 83 | 89 |
| Bonding strength SB High ($J/m^2$)** | 244 | 282 | 326 | 291 | 245 |
| Brightness ISO ts | 73.5 | 71.9 | 71.4 | 71 | 76.8 |
| Brightness D65 ts | 73.9 | 71.9 | 72.6 | 72.25 | 77.6 |
| Opacity (%) | 93 | 92 | 92.8 | 95 | 93 |

TABLE 3-continued

Properties of coated printing papers The coated printing paper according to the invention is sample 9, samples of prior art are samples 10 to 13.

| | Sample | | | | |
|---|---|---|---|---|---|
| | 9 | 10 | 11 | 12 | 13 |
| Air permeance (s/100 ml) | 2200 | 3166 | 797 | 1812 | 710 |
| Roughness PPS (μm) | 2.23 | 1.41 | 1.82 | 1.66 | 2.08 |
| Gloss (%) | | | | | |
| machine direction | 47 | 58 | 54 | 57 | 32 |

**In the measurement of the bonding strength, the scale SB High (210 to 1051 $J/m^2$) has been used.

TABLE 4

Properties of coated printing papers The coated printing paper according to the invention is sample 14, samples of prior art are samples 15 to 17.

| | Sample | | | |
|---|---|---|---|---|
| | 14 | 15 | 16 | 17 |
| Grammage ($g/m^2$) | 54.9 | 54.2 | 54.5 | 53.4 |
| Thickness (μm) | 62 | 57 | 52 | 56 |
| Density ($kg/m^3$) | 887 | 950 | 1054 | 960 |
| Bulk ($cm^3/g$) | 1.12 | 1.05 | 0.95 | 1.04 |
| Filler content 560° C. (%) | 24.1 | 28.9 | 28.1 | 30.5 |
| Mechanical pulp (%) | 100 | 54 | 54 | 71 |
| Chemical pulp (%) | 0 | 46 | 46 | 29 |
| Tensile strength in machine direction (kN/m) | 3.54 | 3.09 | 2.66 | — |
| Elongation (%) | | | | |
| machine direction | 1.2 | 1.25 | 1.5 | — |
| Tear resistance (mN) | | | | |
| cross-machine direction | 198 | 306 | 302 | 258 |
| Bending strength (mN) | | | | |
| machine direction | 33 | 23.5 | — | 21 |
| cross-machine direction | 14 | 12.5 | — | 12 |
| Bending length (mm) | | | | |
| machine direction | 113 | 111 | — | 101 |
| cross-machine direction | 79 | 85 | — | 76 |
| Bonding strength SB High ($J/m^2$)** | 296 | 411 | 560 | 297 |
| Brightness ISO ts | 73.5 | 75 | 72.1 | 71.4 |
| Brightness D65 ts | 73.6 | 75.2 | 75 | 72 |
| Opacity (%) | 93 | 92 | 89.9 | 94.3 |
| Air permeance (s/100 ml) | 260 | 1310 | 220 | 860 |
| Roughness PPS (μm) | 2.39 | 2.52 | 2.97 | 2.18 |
| Gloss (%) | | | | |
| machine direction | 21 | 30 | 23 | 32 |

**In the measurement of the bonding strength, the scale SB High (210 to 1051 $J/m^2$) has been used.

EXAMPLE 3

In the following, one fibre pulp grade will be presented, of which it is possible to make printing paper according to the invention. Of the fibre pulp grade, whose properties are shown in Table 5, unoriented sheets, whose properties are shown in Table 6, were made in a laboratory.

TABLE 5

| Properties of fibre pulp. | | | | | | |
|---|---|---|---|---|---|---|
| | Fibre distribution by Bauer-McNett method | | | | | |
| Freeness (ml CSF) | +16 (%) | +28 (%) | +48 (%) | +200 (%) | −200 (%) | Average fibre length (mm)*** |
| 61 | 34.0 | 10.6 | 17.9 | 16.9 | 20.6 | 1.67 |

***The average fibre length is the average of the length-weighted average fibre length measured with a Kajaani FS-200 device.

TABLE 6

| Properties of unoriented sheets made of fibre pulp. | |
|---|---|
| Grammage (g/m$^2$) | 60.2 |
| Thickness ($\mu$m) | 121 |
| Density (kg/m$^3$) | 497 |
| Bulk (m$^3$/kg) | 2.01 |
| Tensile index (Nm/g) | 55.7 |
| Elongation (%) | 2.46 |
| Breaking energy index (J/kg) | 920.6 |
| Tear index (mNm$^2$/g) | 7.48 |

As seen from the properties in Tables 5 and 6, good strength values are achieved for the fibre pulp. The fibre distribution differs slightly from the typical fibre distribution obtained from the method, wherein it can be stated that the fibre production method provides strong and bondable pulp, even though the fibre distribution did not match the typical fibre distribution obtained by the method.

The invention is not restricted to the description above, but it may vary within the scope of the claims. It is possible to use pulp grades with varying fibre distribution for the manufacture of printed paper, as long as they are refined so that they have good strength values and bondability. The main idea in this invention is that certain printing paper grades can be replaced by using printing paper containing mechanical pulp at least 90 weight-% of the total fibre content of the paper.

What is claimed is:

1. A coated printing paper which contains mechanical pulp and whose opacity is at least 89%, brightness at least 65% and surface roughness not more than 4.5 $\mu$m, wherein the coated printing paper contains mechanical pulp at least 90 weight-% of the total fibre content of the paper.

2. The coated printing paper according to claim 1, wherein the coated printing paper contains mechanical pulp at least 95 weight-% of the total fibre content of the paper.

3. The coated printing paper according to claim 1, wherein the whole fibre content is mechanical pulp.

4. The coated printing paper according to claim 3, wherein the mechanical pulp is thermomechanical pulp (TMP).

5. The printing paper according to claim 4, wherein the thermomechanical pulp is such that, defined by Bauer-McNett screens, 40 to 50% of the fibres will not pass screens with a slot size of 16 mesh and 28 mesh, 15 to 20% of the fibres will pass screens of 16 and 28 mesh but will not pass screens with a slot size of 48 mesh and 200 mesh, and 35 to 40% of the fibres will pass screens of 48 and 200 mesh.

6. A coated printing paper which contains at least 90 weight percent mechanical pulp, based upon the total fibre content of the paper, the mechanical pulp comprising thermomechanical pulp, the coated printing paper having an opacity of at least 89%, a brightness at least 65% and a surface roughness of not more than 4.5 mm, the mechanical pulp having fibres of which 40 to 50% of the fibres will not pass screens with a slot size of 16 mesh and 28 mesh, 15 to 20% of the fibres will pass screens of 16 and 28 mesh but will not pass screens with a slot size of 48 mesh and 200 mesh, and 35 to 40% of the fibres will pass screens of 48 and 200 mesh as defined by Bauer-McNett screens.

7. The coated printing paper according to claim 6, wherein the coated printing paper contains mechanical pulp in an amount of at least 95 weight-% of the total fibre content of the paper.

8. The coated printing paper according to claim 7, wherein the mechanical pulp is thermomechanical pulp.

9. A coated printing paper comprising at least 90 weight percent thermomechanical pulp, based upon the total fibre content of the paper, the paper having an opacity of at least 89%, a brightness at least 65% and surface roughness not more than 4.5 mm, the thermomechanical pulp having fibres of which 40 to 50% of the fibres will not pass screens with a slot size of 16 mesh and 28 mesh, 15 to 20% of the fibres will pass screens of 16 and 28 mesh but will not pass screens with a slot size of 48 mesh and 200 mesh, and 35 to 40% of the fibres will pass screens of 48 and 200 mesh as defined by Bauer-McNett screens.

10. The coated printing paper according to claim 9, wherein the coated printing paper contains thermomechanical pulp in an amount of at least 95 weight-% of the total fibre content of the paper.

* * * * *

UNITED STATES PATENT AND TRADEMARK OFFICE

CERTIFICATE OF CORRECTION

PATENT NO. : 6,923,889 B2
DATED : August 2, 2005
INVENTOR(S) : Jouni Huuskonen et al.

It is certified that error appears in the above-identified patent and that said Letters Patent is hereby corrected as shown below:

Column 12,
Lines 17 and 34, change “4.5 mm” to -- 4.5 $\mu$m --.

Signed and Sealed this

Twenty-seventh Day of December, 2005

JON W. DUDAS
*Director of the United States Patent and Trademark Office*